US008418683B2

(12) United States Patent
Leven

(10) Patent No.: US 8,418,683 B2
(45) Date of Patent: Apr. 16, 2013

(54) ARCHERY VIBRATION ABSORBER

(76) Inventor: William L. Leven, Lancaster, CA (US)

( * ) Notice: Subject to any disclaimer, the term of this patent is extended or adjusted under 35 U.S.C. 154(b) by 290 days.

(21) Appl. No.: 12/802,928

(22) Filed: Jun. 17, 2010

(65) Prior Publication Data

US 2011/0308509 A1 Dec. 22, 2011

(51) Int. Cl.
*F41B 5/20* (2006.01)

(52) U.S. Cl.
USPC ..... 124/89

(58) Field of Classification Search ..... 124/89
See application file for complete search history.

(56) References Cited

U.S. PATENT DOCUMENTS

| | | | | |
|---|---|---|---|---|
| 4,615,327 | A * | 10/1986 | Saunders | 124/89 |
| 5,385,136 | A * | 1/1995 | Thomas | 124/89 |
| 5,975,070 | A * | 11/1999 | Sands | 124/89 |
| 6,186,135 | B1 * | 2/2001 | Harwath et al. | 124/89 |
| 6,494,196 | B2 * | 12/2002 | Harwath et al. | 124/89 |
| 6,681,755 | B2 * | 1/2004 | Pujos | 124/89 |
| 7,213,590 | B2 * | 5/2007 | Pellerite | 124/89 |

* cited by examiner

*Primary Examiner* — John Ricci
(74) *Attorney, Agent, or Firm* — DLA Piper LLP (US)

(57) ABSTRACT

A vibration absorber for an archery bow including a hollow, elongated cap open at both ends, a first dampening plug inserted into one of the ends of the cap and a second dampening plug inserted to another end of the cap and coupled to the first dampening plug within the cap. Typically the cap is made from a stiff material and the first and second dampening plugs are made from elastic material with the same or different elasticities.

4 Claims, 1 Drawing Sheet

ARCHERY VIBRATION ABSORBER

BACKGROUND OF THE INVENTION

1. Field of Invention

The present invention relates to a vibration dampener for an archery bow which dissipates the sound and shock created by the bow when an arrow is shot.

2. Prior Art

There are several devices in the prior art designed to help eliminate vibration and noise in an object. Such devices are shown in U.S. Pat. Nos. 3,412,725; 5,273,022; 5,362,046; 5,513,622; 5,520,164; 5,558,078; 5,615,664; 5,570,730; 5,584,282; 6,085,736; 6,298,892; 6,382,201 and 6,526,957 and U.S. Design Pat. Nos. D436,643; D445,161; and D469,839.

While the devices of the patents above all generally absorb vibration and particularly absorb sound and shock, all of them are generally fixed in their characteristics and cannot be changed to meet the present environment or the particular needs and desires of the user.

SUMMARY OF THE INVENTION

Accordingly, it is the general object of the present invention to overcome the disadvantages of the prior art.

In particular, it is an object of the present invention to provide a vibration absorber wherein the characteristics of the vibration absorber can be changed and/or varied according to the present environment and/or the needs or desires of the user.

The above objects of the present invention are accomplished by a unique vibration absorber including a hollow elongated substantially cylindrically shaped cap open at both ends, a first dampening plug made from an elastic material inserted into one end of the cap and a second dampening plug made from an elastic material inserted into another end of the cap with the first and second dampening plugs coupled together within the cap. The first and second dampening plugs are made from elastic material typically having an elasticity of 25 to 60 Durometers and in some applications may be the same, while in others they may be different.

BRIEF DESCRIPTION OF THE DRAWINGS

The above mentioned features and objects of the present invention will become more apparent with reference to the following description taken together with the accompanied drawings wherein.

DETAILED DESCRIPTION OF THE INVENTION

Figure 1A:
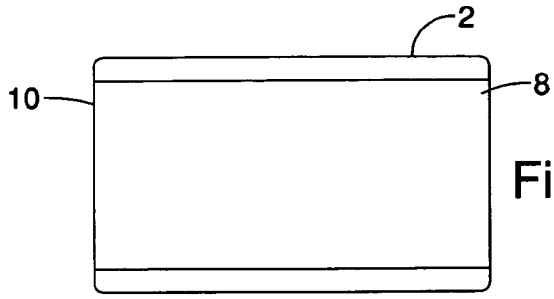
FIGS. 1A, 1B and 1C are cross-sections of the three parts which make up the vibration absorber of the present invention.
Figure 1B:
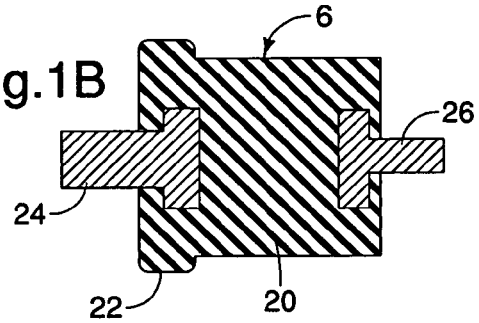
Figure 1C:
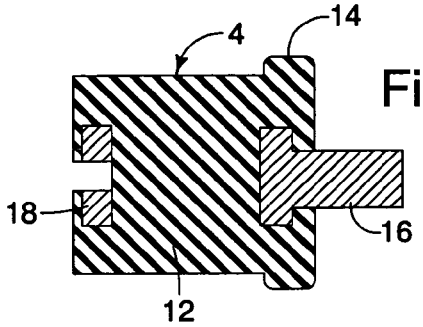

Referring to the FIGS. 1A through 1C and 2, the vibration absorber 1 of the present invention comprises a shell or cap 2, a first dampening plug 4 and a second dampening plug 6. The shell or cap 2 is elongated, hollow and has two open ends. The shell or cap 2 is also substantially cylindrical and can be made of any material which is suitable for the application such as metal, plastic or rubber and can be either machined or molded.

The first dampening plug 4 is made from an elastomeric material, either a resin or a rubber, and includes an insertion part 12 and a lip 14. The size of the insertion part 12 is selected such that it will fit within the hollow portion of the cap 2 and the lip 14 is also selected to have a size such that it extends over the end 8 of the cap 2 to provide a washer like function. Still further, the first dampening plug 4 includes an insert 16 which can be threaded and made from either a metal or a plastic so that the assembled vibration absorber can be mounted to either an archery bow or some other structure. The first dampening plug 4 further includes a second insert 18 which comprises substantially a threaded nut which can be made from either plastic or metal. This insert 18 is useful to couple the first and second dampening plugs 4 and 6 together within the cap 2 as is shown in the FIG. 2.

Figure 2:
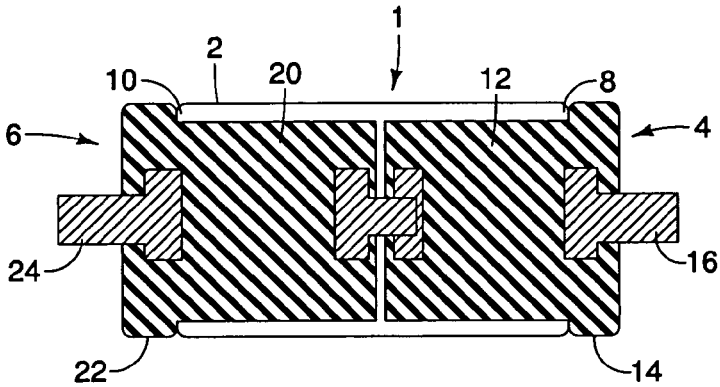
FIG. 2 is a cross-section of the assembled vibration absorber in accordance with the teachings of the present invention and FIG. 3 is a cross-sectional view illustrating the use of the vibration absorber in accordance with the teachings of the present invention.

Similar to the first dampening plug 4, the second dampening plug 6 is made from an elastic material such as a rubber or resin and includes an insertion part 20 and a lip part 22. One end of the second dampening plug 6 is similarly provided with an insert 24 which typically includes a threaded portion for attachment to an accessory and can be made from a hard plastic or a metal. The second dampening plug is further provided with a second insert 26 which is also made from a hard plastic or metal and is provided with a threaded portion for being threadably engaged with the nut 18 within the shell or cap 2 to couple the first and second dampening plugs 4 and 6 together as is shown in FIG. 2. The elasticity of the first and second dampening plugs 4 and 6 is in the range of 25 to 60 Durometers.

As shown in FIG. 2 and mentioned above, the vibration absorber 1 of the present invention is assembled by inserting the first and second dampening plugs 4 and 6 into the openings 8 and 10 of the cap 2 and threading the screw portion of insert 26 into the nut portion of the insert 18 to couple the first and second inserts 4 and 6 together. It should be apparent that other coupling methods could be utilized to couple the first and second inserts 4 and 6 together within the shell or cap 2 without departing from the spirit and scope of the present invention. In addition and as mentioned above, the first and second dampening plugs 4 and 6 can be made from an elastic material which has the same elasticity or has different elasticities, depending on the desire and need of the user.

Figure 3:
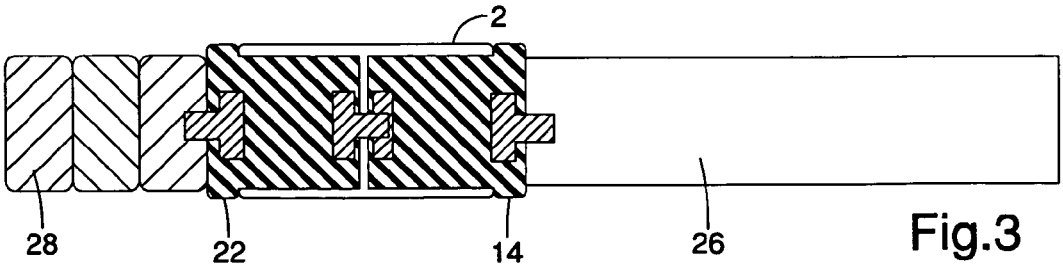

Referring to FIG. 3, shown therein is the vibration absorber 1 of the present invention in use. In particular one end of the vibration absorber 1 is coupled by means of the insert 16 to a stabilizer 26 of an archery bow. The other end of the vibration absorber 1 is coupled to a plurality of weights 28 by means of the insert 24. Accordingly, by varying the number of weights 28, the length and construction of the stabilizer 26 and the elasticity of the first and second dampening plugs 4 and 6, the characteristics of the entire shock absorbing and stabilizing system for the archery bow can be varied to meet the requirements of the environment and the use and desires of the user.

It should be apparent to those skilled in the art that the above described embodiment is but one of many embodiments which could be created by one of ordinary skill in the art without departing from the spirit and scope of the present invention.

The invention claimed is:

1. A vibration absorber for an archery bow comprising:

a hollow, elongated cap open at both ends;

a first dampening plug inserted into one of said ends of said cap; and a second dampening plug inserted into another end of said cap and coupled to said first dampening plug within said cap, wherein the first and second dampening plugs are made of an elastic material having elasticity between 25 and 60 Durometers, and the elasticity of the first and second dampening plugs is different.

2. A vibration absorber for an archery bow comprising:

a hollow, elongated cap open at both ends;

a first dampening plug inserted into one of said ends of said cap; and a second dampening plug inserted into another end of said cap and coupled to said first dampening plug within said cap, wherein the first and second plugs are provided with a lip which covers said ends of said cap.

3. A vibration absorber for an archery bow comprising:

a hollow, elongated cap open at both ends;

a first dampening plug inserted into one of said ends of said cap; and a second dampening plug inserted into another end of said cap and coupled to said first dampening plug within said cap, wherein the first dampening plug is provided with a means for coupling said vibration absorber to an archery bow.

4. A vibration absorber for an archery bow comprising:

a hollow, elongated cap open at both ends;

a first dampening plug inserted into one of said ends of said cap; and a second dampening plug inserted into another end of said cap and coupled to said first dampening plug within said cap, wherein said second dampening plug is provided with a means for coupling said vibration absorber to an accessory for an archery bow.

* * * * *